US008033535B2

(12) United States Patent
Mannon

(10) Patent No.: US 8,033,535 B2
(45) Date of Patent: Oct. 11, 2011

(54) STAIR STRINGER ASSEMBLY BENCH

(76) Inventor: Robert C. Mannon, Atascadero, CA (US)

( * ) Notice: Subject to any disclaimer, the term of this patent is extended or adjusted under 35 U.S.C. 154(b) by 470 days.

(21) Appl. No.: 12/137,587

(22) Filed: Jun. 12, 2008

(65) Prior Publication Data

US 2009/0308004 A1 Dec. 17, 2009

(51) Int. Cl.
*B25B 1/20* (2006.01)

(52) U.S. Cl. ..... 269/43; 269/71; 269/73; 269/291; 29/281.1

(58) Field of Classification Search ..... 269/43, 269/71, 73, 291; 29/281.1, 464, 559; 74/526; 144/2.1, 3.1, 24, 18
See application file for complete search history.

(56) References Cited

U.S. PATENT DOCUMENTS

| | | | | | |
|---|---|---|---|---|---|
| 1,647,365 | A | * | 11/1927 | Kalgren | 269/303 |
| 2,017,775 | A | * | 10/1935 | Thrasher | 144/24.18 |
| 3,250,014 | A | | 5/1966 | Watson | |
| 3,579,184 | A | * | 5/1971 | Forestal | 340/470 |
| 4,033,025 | A | * | 7/1977 | Jureit et al. | 29/417 |
| 4,047,282 | A | * | 9/1977 | Jureit et al. | 29/432 |
| 4,427,191 | A | * | 1/1984 | Hess | 269/43 |
| 4,552,345 | A | * | 11/1985 | Benda et al. | 269/43 |
| 4,628,577 | A | * | 12/1986 | Dahlgren et al. | 29/281.1 |
| 4,635,416 | A | | 1/1987 | Ayala | |
| 4,673,011 | A | | 6/1987 | Lapeyre et al. | |
| 4,764,015 | A | * | 8/1988 | Bieringer et al. | 356/601 |
| 4,817,693 | A | * | 4/1989 | Schuler | 144/359 |
| 4,874,156 | A | * | 10/1989 | Goldzweig | 269/158 |
| 5,098,066 | A | * | 3/1992 | Willcox, III | 254/134 |
| 5,190,266 | A | * | 3/1993 | Barrera | 254/17 |
| 5,205,093 | A | | 4/1993 | Schuette | |
| 5,305,992 | A | * | 4/1994 | Kish | 269/51 |
| 5,330,216 | A | * | 7/1994 | Schnell | 269/45 |
| 5,592,793 | A | | 1/1997 | Damratowski et al. | |
| 6,088,977 | A | | 7/2000 | Lawrence | |
| 6,125,598 | A | | 10/2000 | Lanphier | |
| 6,481,767 | B2 | * | 11/2002 | Pool | 294/16 |
| RE37,928 | E | * | 12/2002 | Howard | 297/362.14 |
| 6,675,541 | B2 | * | 1/2004 | Mackey | 52/208 |
| 7,587,790 | B2 | * | 9/2009 | McCue et al. | 16/404 |
| 7,587,802 | B2 | * | 9/2009 | Tsuchiya et al. | 29/407.01 |
| 7,600,744 | B2 | * | 10/2009 | Liou | 269/166 |
| 7,798,187 | B1 | * | 9/2010 | Duginske | 144/253.1 |
| 2002/0195446 | A1 | * | 12/2002 | Galloway | 219/652 |
| 2009/0308004 | A1 | * | 12/2009 | Mannon | 52/191 |

* cited by examiner

*Primary Examiner* — George Nguyen
(74) *Attorney, Agent, or Firm* — Thomas F. Lebens; Sinsheimer, Juhnke, Lebens & McIvor, LLP

(57) ABSTRACT

A stair making apparatus is disclosed. The stair making apparatus comprising a bench adapted to support a plurality of members and a beam; a stop fixture connected to the bench, the stop fixture having a plurality of stops for individually engaging each of the plurality of members; and one or more fasteners connected with the bench, the one or more fasteners configured to cooperate with the plurality of stops to brace the beam and the plurality of members in a form of a stair stringer.

10 Claims, 10 Drawing Sheets

STAIR STRINGER ASSEMBLY BENCH

BACKGROUND OF THE INVENTION

1. Field of the Invention

The present invention relates generally to work benches. More specifically the present invention relates to a work bench for assembling stair stringers.

2. Discussion of the Related Art

A typical staircase is comprised of an alternating series of treads and risers that form the individual steps of the staircase. The treads, and in most cases the risers, are supported by a pair of stair stringers that form part of the staircase structure. Stair stringers are frequently constructed at a construction worksite where the staircase is to be constructed.

To construct a typical stair stringer, a carpenter will "layout" a stair stringer by marking a single 2×12, 2×14 or other sized piece of lumber with layout lines. The layout lines identify the contour or shape of the stair stringer. The shape of the stair stringer generally comprises an elongated beam with multiple triangular edges that support the individual treads and risers. The carpenter saws along the layout lines that define the triangular edges leaving a stair stringer. The carpenter will then usually dispose of the remaining pieces of lumber as waste.

A matching stair stinger is constructed similarly. The carpenter carefully marks a single piece of lumber with layout lines and saws a complementary stair stringer from the single piece of lumber. The carpenter typically disposes of the remaining lumber as waste. The stair stringer and the matching stair stringer are then installed parallel to each other. Treads and risers are attached to the pair of stair stringer forming a staircase.

It can be appreciated that the carpenter must carefully layout and saw the stair stringer and matching stair stringer to allow accurate placement of the treads and risers. It can also be appreciated that the task of cutting stair stringers from a single piece of lumber is a time consuming task; particularly, since most carpenters at a worksite spend a very small proportion of their time at this task. Moreover, lumber waste is an undesirable residue of this process.

Those skilled in the art will recognize that there is a need for an apparatus that allows a carpenter to: quickly, easily and accurately construct the stair stringers of a staircase with little lumber waste. It can also be appreciated that an apparatus that can be used to make stair stringers at a lumberyard would allow carpenters to specialize in constructing stair stringers, allowing mass production of stair stringers for multiple construction worksites. Applicant's invention addresses these needs as well as other needs.

SUMMARY OF THE INVENTION

In one embodiment, the invention can be characterized as a stair making apparatus, comprising: a bench adapted to support a plurality of members and a beam; a stop fixture connected to the bench, the stop fixture having a plurality of stops for individually engaging each of the plurality of members; and one or more fasteners connected with the bench, the one or more fasteners configured to cooperate with the plurality of stops to brace the beam and the plurality of members in a form of a stair stringer.

In a further embodiment, the invention may be characterized as a stop fixture for making stair stringers, the stop fixture comprising: a rotatable shaft having a first threaded end and a second threaded end, a first stop coupled to the first threaded end of the rotatable shaft, the first stop for engaging a first member; and a last stop coupled to the second threaded end of the rotatable shaft, the last stop for engaging a last member.

In still another embodiment, the invention may be characterized as a stop fixture for making stair stringers, the stop fixture comprising: a shaft; a first stop coupled to the shaft for engaging a first member; a second stop adjacent to the first stop and coupled to the shaft at a predetermined distance from the first stop, the second stop for engaging a second member; a third stop adjacent to the second stop and coupled to the shaft at the predetermined distance from the second member, the third stop for engaging a third member; and means for translating the second stop and the third stop, wherein when the second stop and the third stop are translated a first distance between the first stop and the second stop remains substantially equal to a second distance between the second stop and the third stop.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
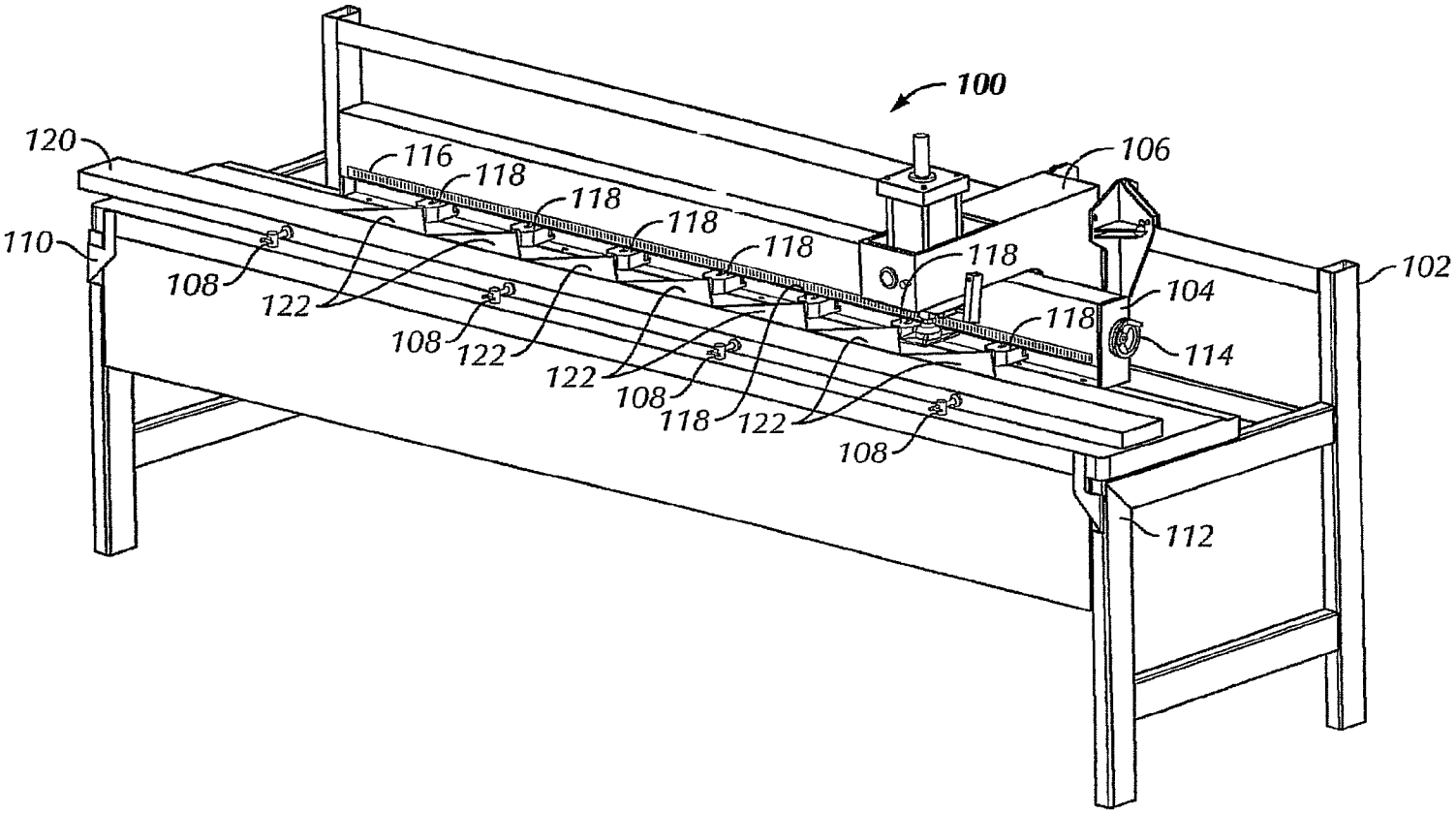
FIG. 1 shows an illustration of a stair stringer assembly bench supporting a beam and a plurality of members configured in the form of a stair stringer according to an embodiment of the invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Figure 2:
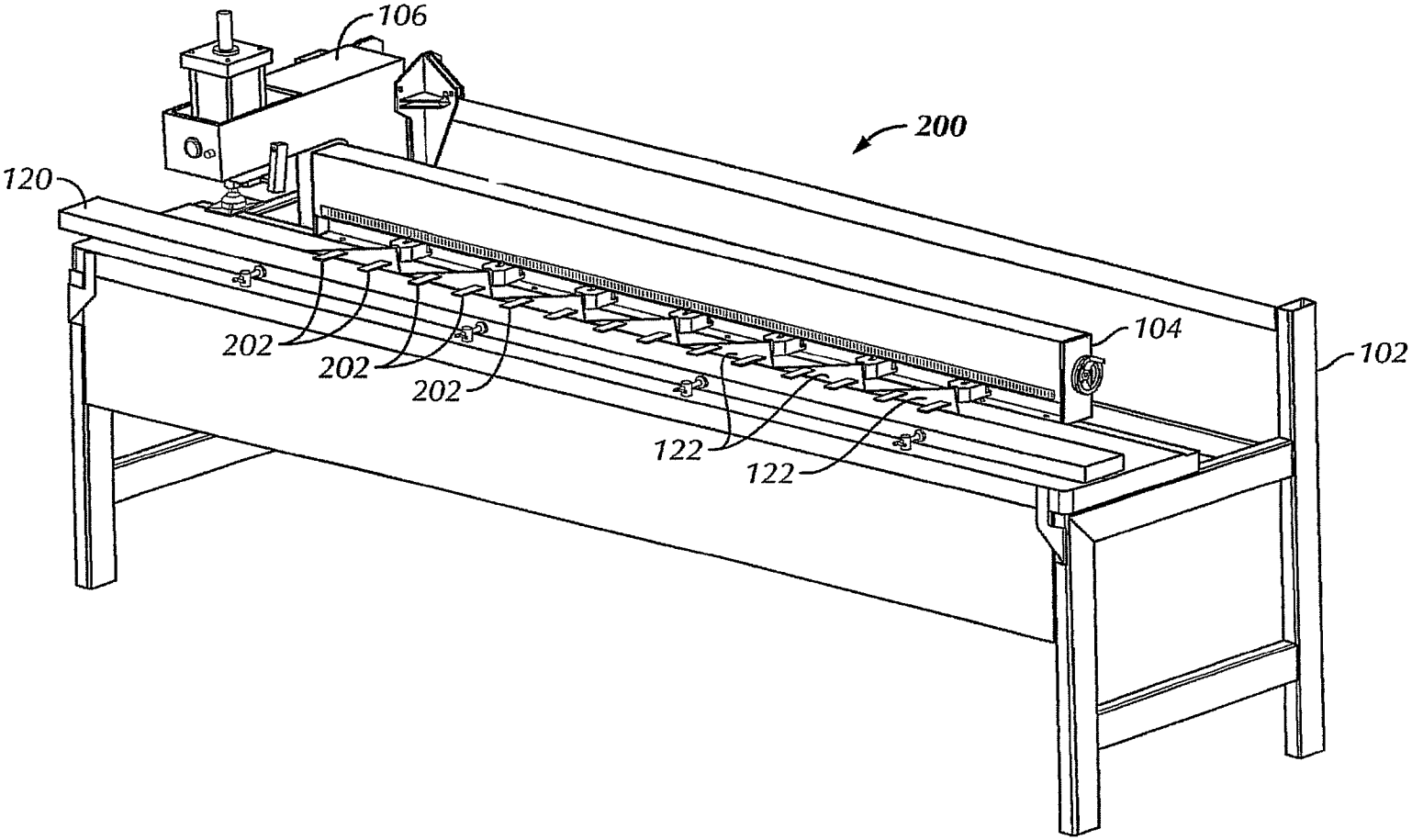
FIG. 2 shows an illustration of a stair stringer assembly bench supporting the beam and the plurality of members shown in FIG. 1, the plurality of members coupled to the beam with ties according to an embodiment of the invention.
Figure 3:
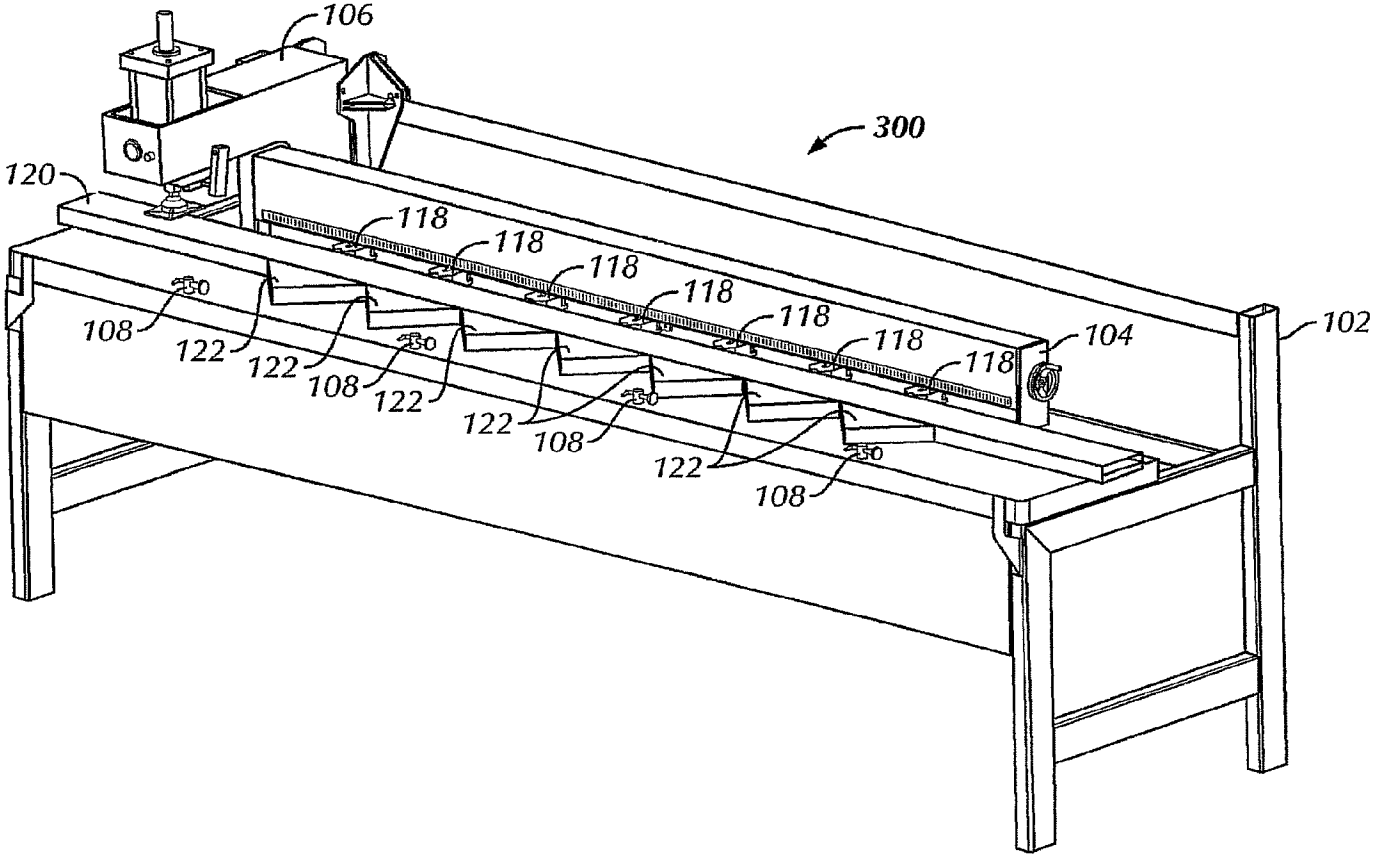
FIG. 3 shows an illustration of a stair stringer assembly bench supporting the beam and the plurality of members shown in FIG. 2, the beam and the plurality of members flipped and configured for application of ties on an opposite side.

FIGS. 1-3 show illustrations of a stair stringer assembly bench supporting a beam and a plurality of members configured in the form of a stair stringer. Specifically, FIG. 1 shows an illustration of a stair stringer assembly bench supporting a beam and a plurality of members in the form of a stair stringer before metal ties have been used to fasten the plurality of members to the beam 100. FIG. 2 shows an illustration of a stair stringer assembly bench supporting a beam and a plurality of members after metal ties have been used to fasten the plurality of members to the beam 200. FIG. 3 shows an illustration of a stair stringer assembly bench supporting a beam and a plurality of members flipped and configured for the application of ties to the other side of the stair stringer 300.

The stair stringer assembly bench 102 shown in FIGS. 1-3 includes a stop assembly 104, a pneumatic press 106 and a plurality of fasteners 108. The stair stringer assembly bench 102 also has a left support 110 and right support 112. The stop assembly 104 includes a hand wheel 114, a positioning tape 116, and a plurality of stops 118. On top of the stair stringer assembly bench 102 is a beam 120 and a plurality of members 122. In FIG. 2, a plurality of ties 202 are affixed to the beam 120 and the plurality of members 122.

The stair stringer assembly bench 102 supports the beam 120 and the plurality of members 122. The plurality of stops 118 in this embodiment are spaced uniformly and are shaped to engage the substantially right angle tips of the plurality of members 122. The plurality of stops 118 cooperates with the plurality of fasteners 108 to secure the plurality of members 122 and the beam 120 in the form of a stair stringer. In this and many other embodiments the hand wheel 114 is operable to uniformly adjust the distance between stops allowing the carpenter to increase or decrease the separation between the plurality of members 122. This provides the bench with the capability to accommodate different sizes and shapes of beams and members for a variety of different types and sizes of stair stringers.

A positioning tape 116 in many embodiments allows the carpenter to easily inspect the distance between members. Markings may be used in conjunction with the position tape place to show typical distances or indicate appropriate stop positions for a variety of different sizes and types of stair stringers. The positioning tape 116 thus may be used by the carpenter to quickly adjust the stop distances using the hand wheel 114.

Those skilled in the art will readily recognize that there are many alternative embodiments that include different stop separation measuring features. For example, some embodiments feature a meter mechanically connected to the hand wheel that provides numeric indicia of the separation between the plurality of stops 118. Other embodiments feature no positioning tape 116 or measuring device.

In this embodiment, the fasteners 108 are wing nut clamps and the plurality of stops 118 have embedded springs. The wing nut clamps can be tightened forcing the beam 120 and the plurality of members 122 up against the plurality of stops 118 compressing the embedded springs and bracing the beam 120 and the plurality of members 122 in the form of a stair stringer.

Alternate embodiments feature different types of fasteners 108 and stops. In some embodiments the plurality of stops 118 do not include embedded springs. In some embodiments the fasteners 108 are spring loaded. In some embodiments the stair stringer assembly bench 102 features grooved edges and cutouts for securing the beam 120 to the plurality of members 122.

In this embodiment, the pneumatic press 106 is slide-ably mounted on the stair stringer assembly bench 120. The pneumatic press 106 can be moved along the bench as can be seen by the different positions of the pneumatic press 106 in FIGS. 1 and 2. This allows the carpenter to easily position the pneumatic press 106 and press ties 202 over appropriate portions of the beam 120 and the plurality of members 122. The pneumatic press 106 can then be used to press the ties into the beam 120 and the plurality of members 122 as shown in FIG. 2. The fasteners 108 may then be loosened to allow a carpenter to flip the beam 120 and the plurality of members 122 as shown in FIG. 3. The carpenter can then easily push the beam 120 up against the plurality of stops 118 allowing the carpenter to use the pneumatic press 106 to apply ties to the other side of the stair stringer form further securing the beam 120 to the plurality of members 122.

In alternate embodiments, the pneumatic press 106 is embodied as a mechanical, hydraulic or other type of press. Still other embodiments feature no press at all with the carpenter securing the beam 120 to the plurality of members 122 with other fastening products such as glue, non-press ties or the like. The use of both metallic and nonmetallic ties in conjunction with the stair stringer assembly bench 120 is contemplated.

The left support 110 and right support 112 can be used to hold the beam 120 or in other embodiments a plurality of beams. A convenient use of the left support 110 and right support 112 is manifest by placing the beam 120 in the supports before the plurality of members 122 are placed on the plurality of stops 118. The beam 120 may then easily be lifted, rotated into place and secured with the fasteners 108 as shown in FIG. 1.

It can be appreciated that the stair stringer assembly bench can be used to quickly and accurately assemble a stair stringer. The carpenter adjusts the plurality of stops 118 using the hand wheel 114. He then places the plurality of members 122 into the plurality of stops 118, lifts and rotates the beam 120 into place and uses the pneumatic press 106 to apply ties to secure the beam 120 to the plurality of members 122. The carpenter then flips the resulting stair stringer form and pushes the beam 120 against the plurality of stops 118 and applies ties to the other side of the stair stringer form completing the stair stringer.

Those skilled in the art will recognize that the stair stringer assembly bench may be used in an assembly line fashion. Lumberyards and other retailers can use the assembly bench to mass produce stair stringer assemblies for contractors saving the contractors time, effort and money.

Figure 4:
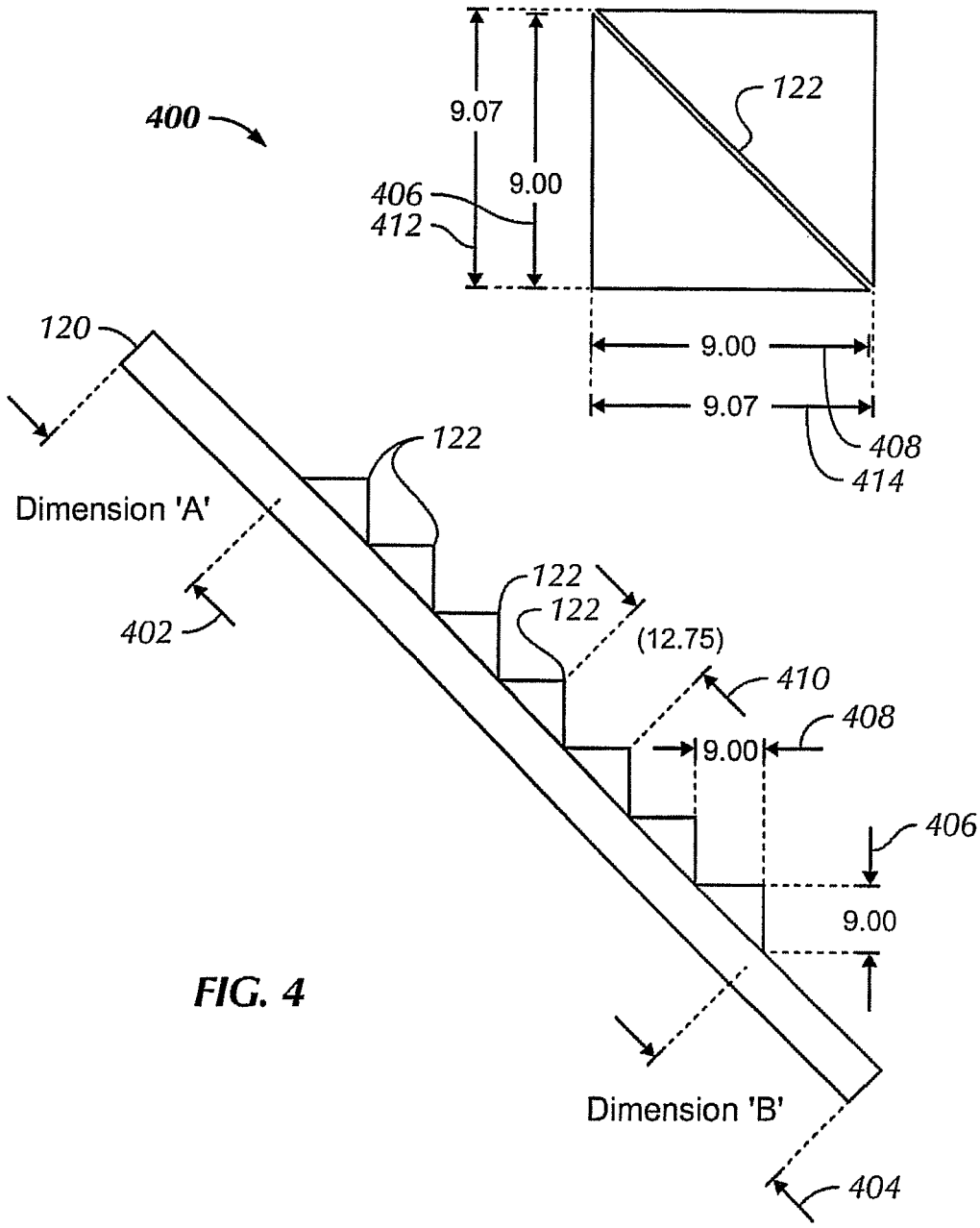
FIG. 4 shows a schematic of an exemplary beam and a plurality of members used to produce a stair stringer according to an embodiment of the invention.

FIG. 4 shows a schematic of an exemplary beam and a plurality of members 400 used to produce a stair stringer according to an embodiment of the invention. The beam 120 used to form the stair stringer has an "A" dimension 402 and a "B" dimension 404. Each of the plurality of members 122 has a riser dimension 406 and a tread dimension 408. The riser dimension 406 and the tread dimension 408 determine a step to step dimension 410. The step to step dimension is important because it determines the stop to stop separation that the carpenter should use when using the stair stringer assembly bench (not shown). A precut riser dimension 412 and tread dimension 414 are also shown.

To construct the members of the stair stringer, the riser dimension 406 and tread dimension 408 are determined. In this exemplary case, the riser dimension 406 and the tread dimension 408 are both 9.0 inches. The riser dimension 406 of 9.0 inches and the tread dimension 408 of 9.0 inches results in a step to step dimension of about 12.75 inches. The step to step dimension for different riser dimensions and tread dimensions can be calculated using the Pythagorean Theorem.

$$\text{Step to Step Dimension} = \text{Square root of } [(\text{riser dimension})^2 + \text{tread dimension squared})^2]$$

To fashion two of the plurality of members 122 the carpenter can cut a rectangular piece from corner to corner. The rectangular piece should have a precut riser dimension 412 and tread dimension 414 that accounts for cutting loss. In this case, the precut riser dimension 412 and the precut tread dimension 414 are both 9.07 inches.

In this example, the riser dimension 406 and tread dimension 408 are the same. However, the calculations are equally valid for stair stringers having different sized treads and risers.

Dimension A 402 represents the upper portion of the stair stringer that will extend beyond the risers and the treads. Dimension B 404 represents the lower portion of the stair stringer that will extend beyond the risers and the treads. Those skilled in the art will recognize that the carpenter assembling the stair stringer should know either dimension A 402 or dimension B 404 when assembling the stair stringer, to insure proper alignment of the 120 beam with the plurality of members 122 on the stair stringer assembly bench (not shown).

Figure 5:
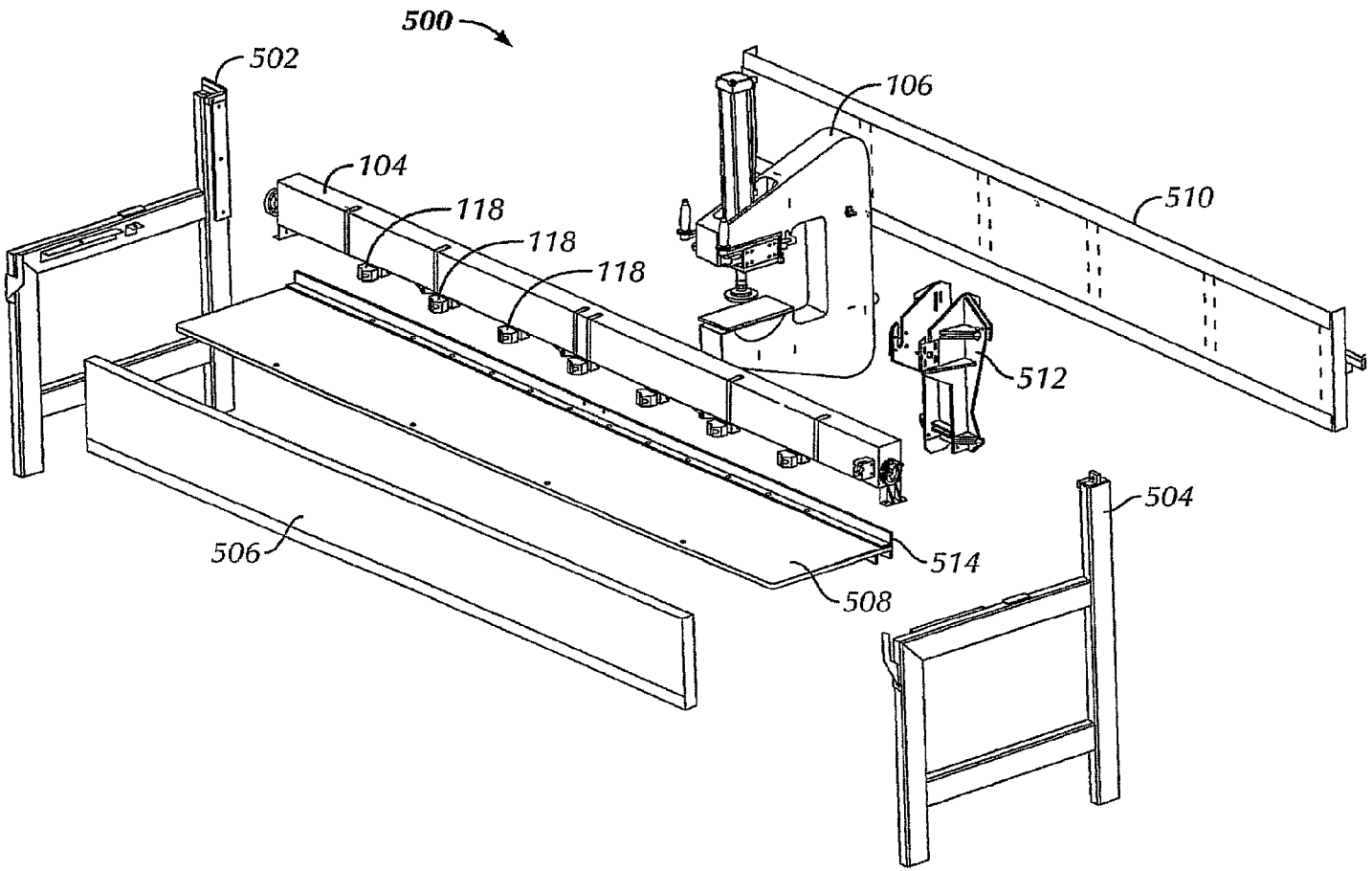
FIG. 5 shows an exploded view of a stair stinger assembly according to an embodiment of the present invention.

FIG. 5 is an exploded view of a stair stinger assembly 500 according to an embodiment of the present invention. A left bench support 502 and a right bench support 504 are shown. Strung between the left bench support 502 and the right bench support 504 are a front panel 506, a top surface 508 and a back surface 510. A sliding mount 512 is slide-ably mounted on the back surface 510. The sliding mount 512 rotate-ably supports the pneumatic press 106. The top surface 508 has a lip 514 that extends upward to prevent the stop fixture 104 from rotating when the plurality of stops 122 is engaged by the plurality of members (not shown).

Those skilled in the art will recognize that this is an exemplary embodiment of the stair stringer assembly bench and that in other embodiments some of the parts shown may be embodied as different structures or their function may be incorporated in other parts.

Figure 6:
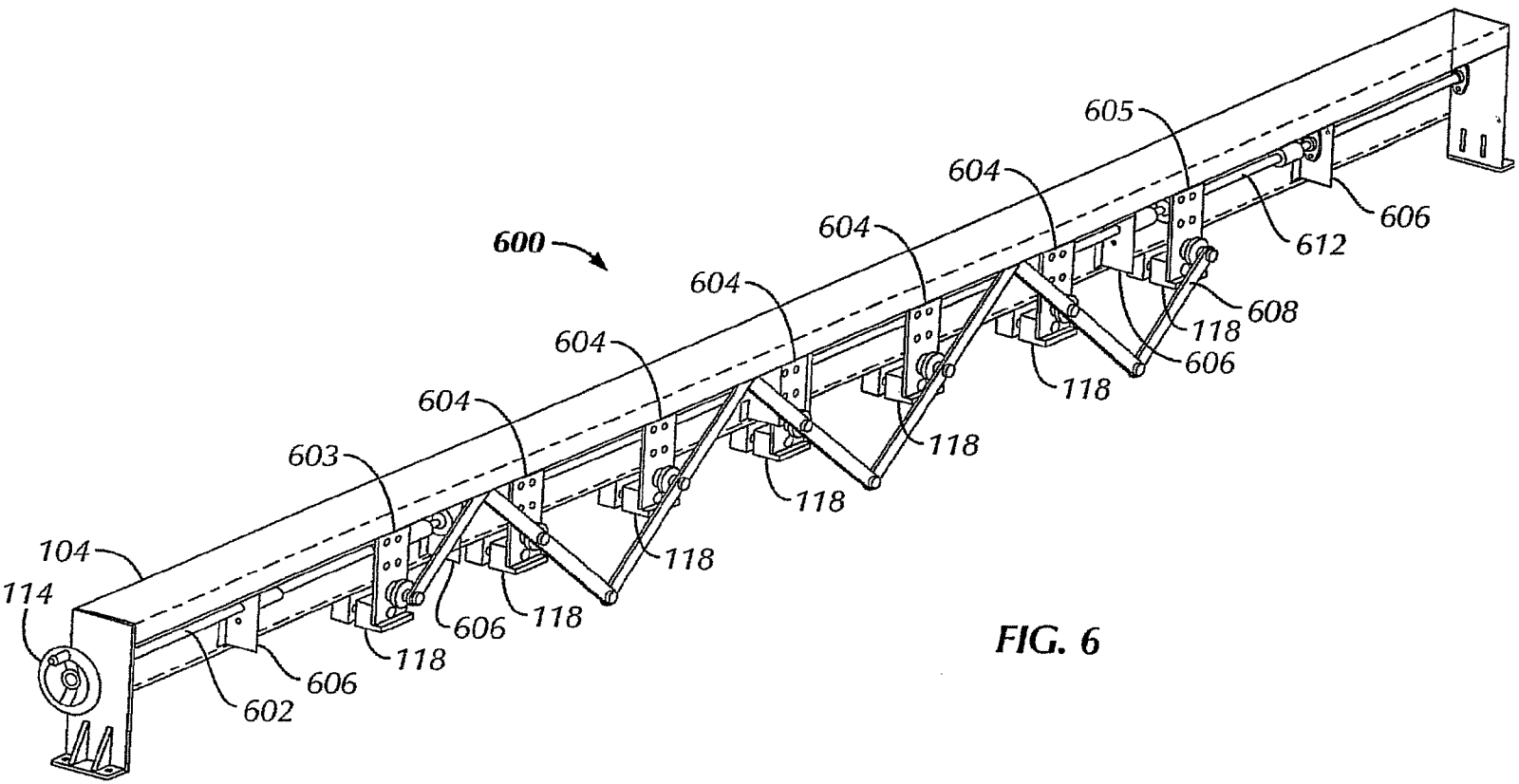
FIG. 6 shows a stop fixture according to an embodiment of the present invention.

FIG. 6 shows an illustration of an exemplary stop fixture according to an embodiment of the present invention 600. The stop fixture 104 has a shaft 602 that is connected to a hand wheel 114. Connected to the shaft 602 is a plurality of stop assemblies 604 that support the plurality of stops 118. Stop plates 606 are arranged around a first stop assembly 603 and a last stop assembly 605. A panagraph 608 connects each of the plurality of stop assemblies 604 including a first stop assembly 603 and a last stop assembly 605. The shaft 602 has a threaded section 610 that extends between stop plates 606 arranged around the first stop assembly 603. The shaft 602 also has a reverse threaded section 612 that extends between stop plates 606 arranged around the last stop assembly 605.

In this embodiment, turning the hand wheel 114 rotates the shaft causing the first stop assembly 603 to translate along the threaded section 610 and causing the last stop assembly 605 to translate along the reverse threaded section 612. This results in the panagraph 608 expanding or contracting depending on the direction of rotation of the hand wheel 114. The expansion or contraction of the panagraph 608 causes the plurality of stop assemblies 604 to move sympathetically. As the stop assemblies 604 move sympathetically, the distances between the plurality of stops 118 changes synchronously and uniformly.

Those skilled in the art will recognize that this synchronous and uniform change allows a carpenter to easily adjust the distance between the plurality of stops 118. The distance can thus easily be set to the step to step distance of the stair stringer. After setting the distance the carpenter can quickly and easily place the plurality of members (not shown) flush against the stops.

Figure 7:
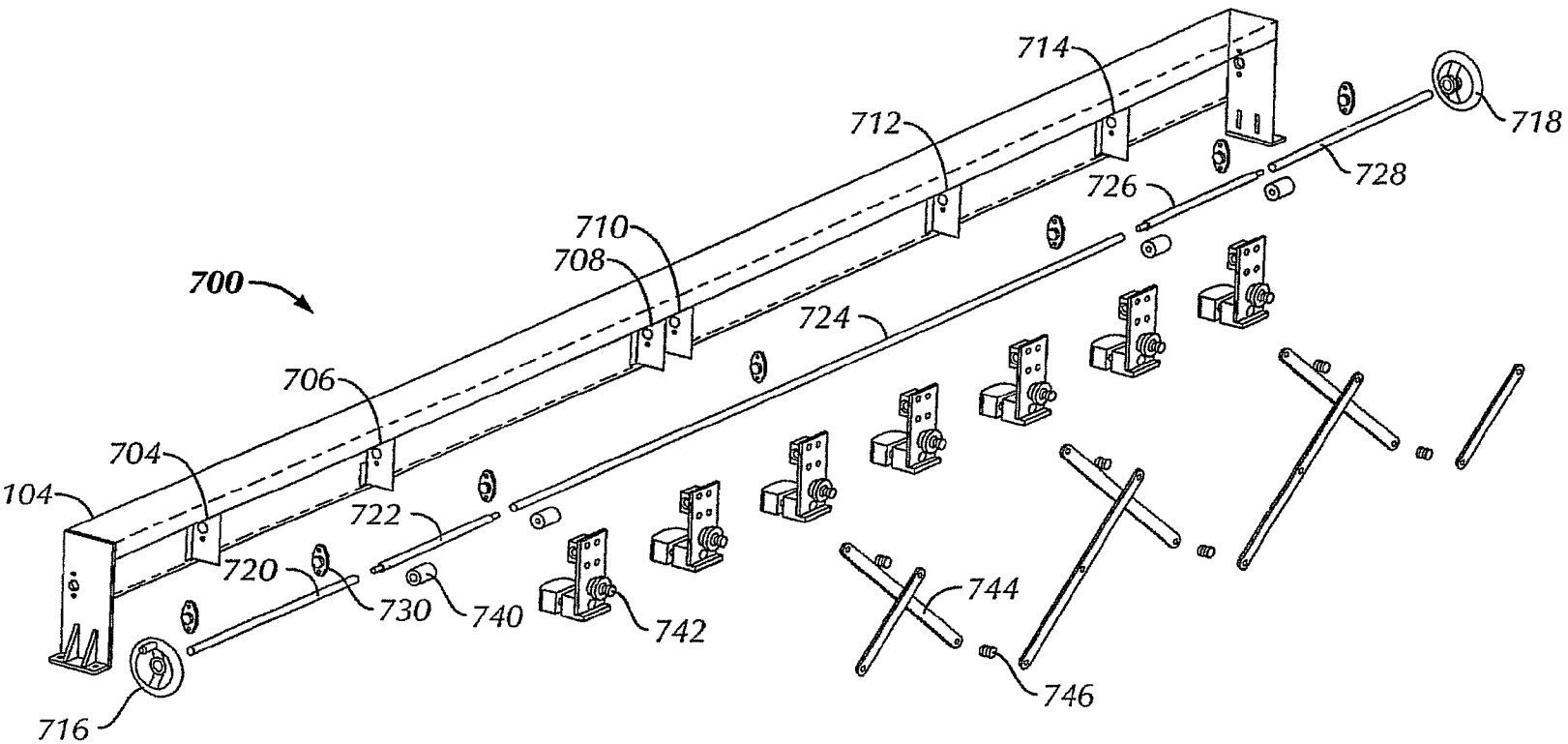
FIG. 7 shows an exploded view of a stop fixture according to an embodiment of the present invention.

FIG. 7 shows an exploded view of a stop fixture according to an embodiment of the present invention 700. In this embodiment, the stop fixture 104 has a first stop plate 704, a second stop plate 706, a third stop plate 708, a fourth stop plate 710, a fifth stop plate 712 and a sixth stop plate 714. A first hand wheel 716 and a second hand wheel 718 are also provided. The first hand wheel 716 is connected with a first shaft segment 720, that is connected with a second shaft segment 722 having threads (not shown), that is connected with a third shaft segment 724, that is connected with a fourth shaft segment 726 having opposite threads (not shown) as the second shaft segment 722, that is connected with a fifth shaft segment 728 that is connected with the second hand wheel 718. The shaft segments are supported in the stop fixture 104 by flange bearings 730. The shaft segments are mutually connected a plurality of shaft couplings 740. Stop assemblies 742 ride on the shaft segments with a first stop assembly riding on the second shaft segment 722, a last stop assembly riding on the fourth shaft segment 726 and the other stop assemblies riding along the third shaft segment. A panagraph constructed from bars 744 and pins 746 is coupled to the stop assemblies 742. The stop assemblies 742 are arranged such that each stop assembly is equidistance from another stop assembly.

It can be readily recognized that the parts used to construct stop fixture 104 are exemplary and that other embodiments feature different designs and structures that allow a carpenter to easily adjust the distance between the plurality of stops 118.

Figure 8:
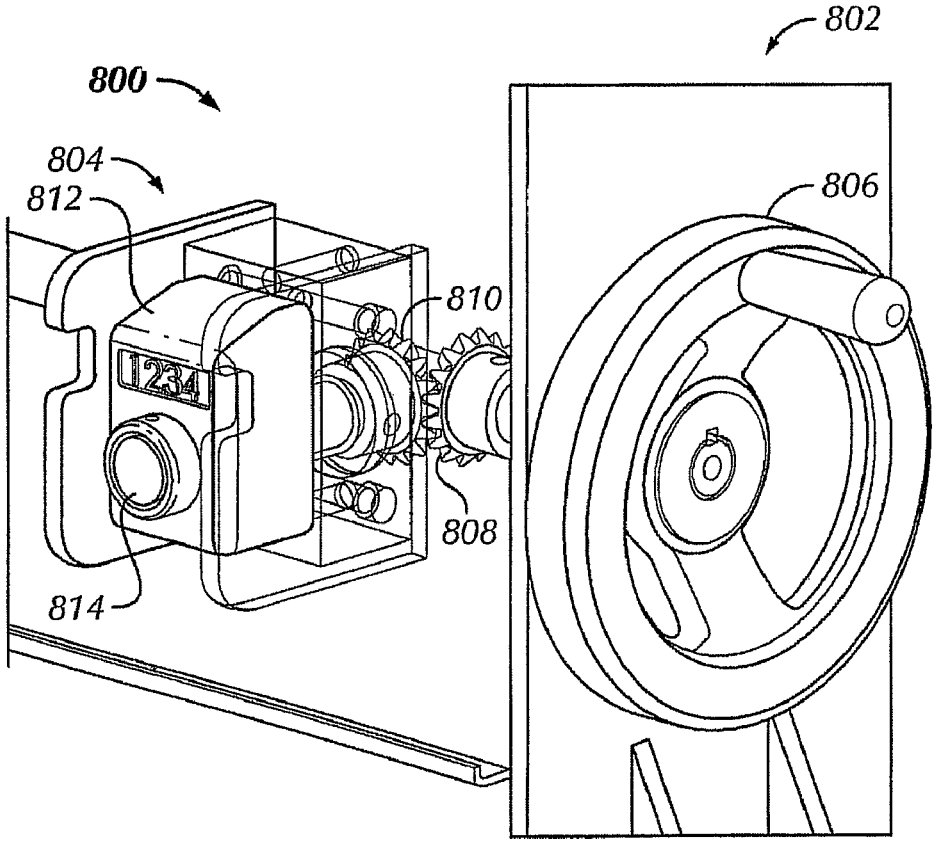
FIG. 8 shows a shaft wheel and a spacing indicator according to an embodiment of the present invention.

FIG. 8 shows a shaft rotation assembly and a meter assembly according to an embodiment of the present invention 800. The shaft rotation assembly 802 is connected with the meter assembly 804. The shaft rotation assembly 802 includes a hand wheel 806 that has a rotation gear 808. The meter assembly 804 has a meter gear 810 that is connected with the rotation gear 808. The meter assembly 804 also includes a display 812 and a reset button 814.

When a carpenter turns the hand wheel 806 the rotation gear 808 turns proportionately. The rotation gear 808 turns the meter gear 810 as well as the shaft supporting the stop assemblies (not shown). The display 804 shows the amount of movement of the stop assemblies connected to the shaft. A reset button 814 allows the carpenter to reset the display value to a nominal value. Using the shaft rotation assembly and meter assembly 800 the carpenter can easily adjusts the relative distances between stops allowing the carpenter to set the appropriate step to step distance for the stair stringer the carpenter is assembling.

Figure 9:
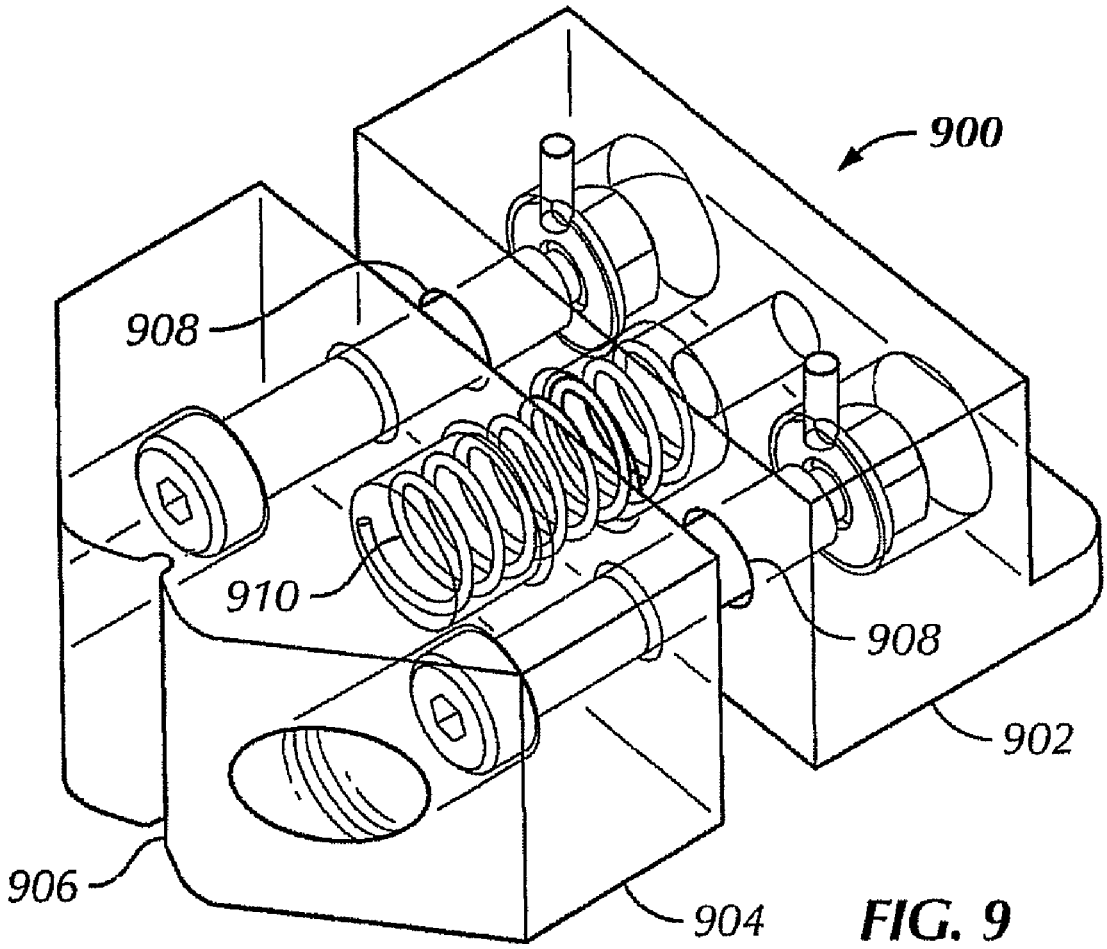
FIG. 9 shows a stop according to an embodiment of the present invention.

FIG. 9 shows a stop 900 according to an embodiment of the present invention. The stop 900 has a base 902 and a head 904. The head 904 has a contoured tip 906 adapted to accept the edge of a member (not shown). The base 902 and the head 904 are connected via a pair of shoulder bolts 908 and a spring 910.

The spring 910 applies a force to the base 902 and the head 904. The force separates the base 902 from the head 904 when the stop 900 is in its quiescent state. When the edge of one of the plurality of members (not shown) is pressed up against the contoured tip 906, a force is applied the spring 910 compressing the spring 910 and applying a reaction force to the member. As explained above, the stop 900 cooperates with the plurality of fasteners 108 to hold the beam (not shown) and the plurality of members (not shown) in the form of a stair stringer.

Figure 10:
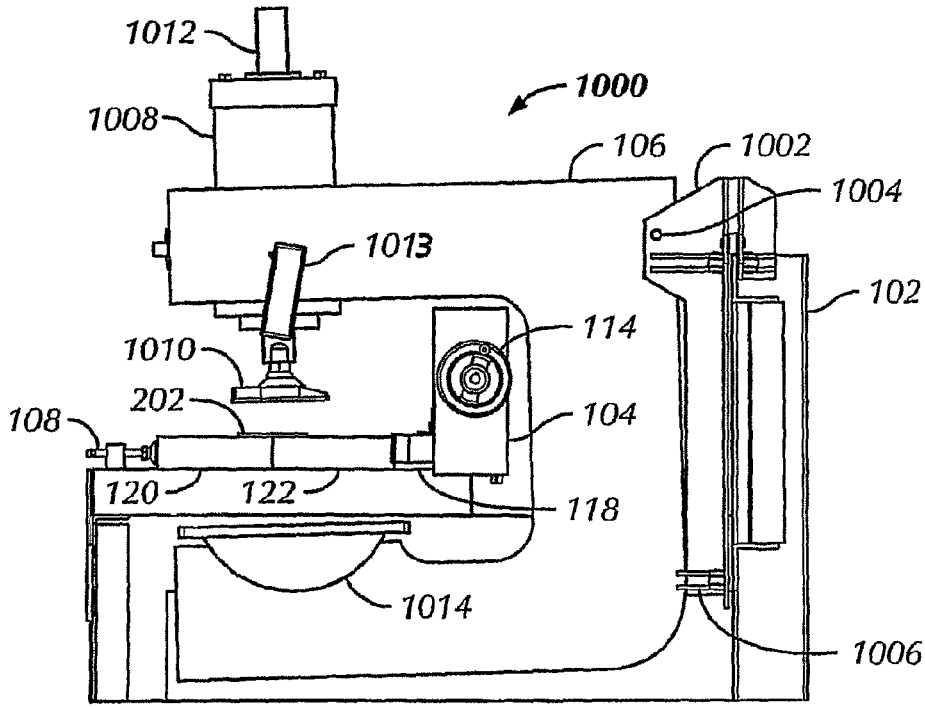
FIG. 10 shows a press according to an embodiment of the present invention.
Figure 11:
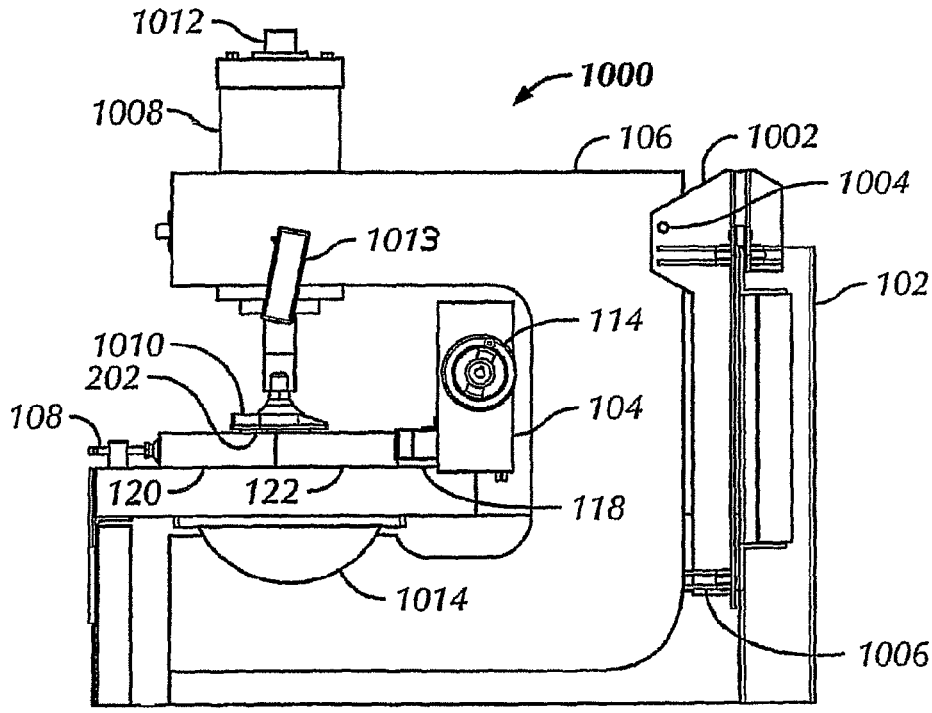
FIG. 11 shows the press of FIG. 10 pressing a tie according to an embodiment of the present invention.

FIGS. 10-11 show a pneumatic press according to an embodiment of the present invention. Specifically FIG. 10 shows the pneumatic press 106 in its quiescent position 1000. FIG. 11 shows the pneumatic press 106 in its press position 1100.

The pneumatic press 106 is generally U shaped and is attached to a mount 1002 via a pin 1004. The mount 1002 is slide-ably attached to the stair stringer assembly bench 102. The mount 1002 has a rotation guide 1006 proximate to the pneumatic press 106. The pneumatic press 106 includes a piston chamber 1008 surrounding a piston 1012 that terminates in a press 1010. The piston chamber 1008 and the piston are mounted via a rotating joint 1013. In complementary relationship with the press 1010 is a rotating anvil 1014.

Apparent in FIGS. 10-11 is one of the plurality of fasteners 108 cooperating with the one of the plurality of stops 118 to secure the beam 120 and the one of the plurality of members 122 in the form of a stair stringer. Also apparent is the stop fixture 104 and the hand wheel 114 more fully described above.

In operation, air forces the piston 1012 down on to one of the plurality of ties 202. The force causes the rotating joint 1013 to rotate and the rotatable anvil 1014 to swivel substantially normal to the applied force. In addition, the pneumatic press 106 rotates relative to the mount via pin 1004 and is guided by the guide 1006. The rotating joint 1013, the rotating anvil 1014 and the pin 1004 cooperate and insure that most of the pneumatic forces during operation are distributed throughout the pneumatic press 106 with only a small amount of force being transferred the stair stringer assembly bench.

While the invention herein disclosed has been described by means of specific embodiments, examples and applications thereof, numerous modifications and variations could be made thereto by those skilled in the art without departing from the scope of the invention set forth in the claims.

What is claimed is:

1. A stair making apparatus, comprising:

a bench adapted to support a plurality of members and a beam;

a stop fixture connected to the bench, the stop fixture having a plurality of stops for individually engaging each of the plurality of members, wherein the stop fixture includes a panagraph, the panagraph coupled to each of the plurality of stops and operable to uniformly change a distance between each of the plurality of stops; and one or more fasteners connected with the bench, the one or more fasteners configured to cooperate with the plurality of stops and brace the beam and the plurality of members in a form of a stair stringer.

2. The stair making apparatus of claim 1 wherein the stop fixture includes a shaft with each of the plurality of stops connected to the shaft.

3. The stair making apparatus of claim 1 wherein the one or more fasteners are clamps.

4. The stair making apparatus of claim 1 further comprising a plurality of springs attached to the plurality of stops and adapted to apply a force to each of the plurality of members bracing the plurality of members against the beam.

5. The stair making apparatus of claim 1 wherein the stop fixture includes an index for measuring a distance between each of the plurality of stops.

6. The stair making apparatus of claim 1 further comprising a plurality of hangers for holding the beam.

7. A stair making apparatus, comprising:

a bench adapted to support a plurality of members and a beam;

a stop fixture connected to the bench, the stop fixture having a plurality of stops for individually engaging each of the plurality of members wherein the stop fixture includes a shaft with each of the plurality of stops connected to the shaft, wherein the shaft has a first threaded portion and a second reverse threaded portion and a first stop among the plurality of stops engages the first threaded portion and a second stop among the plurality of stops engages the second reverse threaded portion, whereby rotation of the shaft translates the first stop and the second stop in opposite directions; and one or more fasteners connected with the bench, the one or more fasteners configured to cooperate with the plurality of stops and brace the beam and the plurality of members in a form of a stair stringer.

8. A stair making apparatus, comprising:

a bench adapted to support a plurality of members and a beam;

a stop fixture connected to the bench, the stop fixture having a plurality of stops for individually engaging each of the plurality of members;

a pneumatic press coupled to the bench and configured to fasten a tie to the beam and to at least one of the plurality of members; and one or more fasteners connected with the bench, the one or more fasteners configured to cooperate with the plurality of stops and brace the beam and the plurality of members in a form of a stair stringer.

9. The stair making apparatus of claim 8 wherein the pneumatic press is coupled to the bench through a U joint and a hinge, the hinge allowing the pneumatic press to rotate and bear substantially all of a stress load when the pneumatic press is operated.

10. A stop fixture for making stair stringers, the stop fixture comprising:

a shaft;

a first stop coupled to the shaft for engaging a first member;

a second stop adjacent to the first stop and coupled to the shaft at a predetermined distance from the first stop, the second stop for engaging a second member;

a third stop adjacent to the second stop and coupled to the shaft at the predetermined distance from the second member, the third stop for engaging a third member; and means for translating the second stop and the third stop, wherein when the second stop and the third stop are translated a first distance between the first stop and the second stop remains substantially equal to a second distance between the second stop and the third stop.

* * * * *